US011164515B2

(12) United States Patent
Lin et al.

(10) Patent No.: US 11,164,515 B2
(45) Date of Patent: Nov. 2, 2021

(54) SENSING CONSIDERING IMAGE

(71) Applicant: Apple Inc., Cupertino, CA (US)

(72) Inventors: Hung Sheng Lin, San Jose, CA (US); Hyunwoo Nho, Palo Alto, CA (US); Sun-Il Chang, San Jose, CA (US); Junhua Tan, Saratoga, CA (US); Jie Won Ryu, Santa Clara, CA (US); Shengkui Gao, San Jose, CA (US); Rui Zhang, Sunnyvale, CA (US); Injae Hwang, Cupertino, CA (US); Kingsuk Brahma, Mountain View, CA (US); Jesse Aaron Richmond, San Francisco, CA (US); Shiping Shen, Cupertino, CA (US); Hyunsoo Kim, Mountain View, CA (US)

(73) Assignee: APPLE INC., Cupertino, CA (US)

( * ) Notice: Subject to any disclaimer, the term of this patent is extended or adjusted under 35 U.S.C. 154(b) by 46 days.

(21) Appl. No.: 16/603,188

(22) PCT Filed: Mar. 27, 2018

(86) PCT No.: PCT/US2018/024580

§ 371 (c)(1),
(2) Date: Oct. 4, 2019

(87) PCT Pub. No.: WO2018/187091

PCT Pub. Date: Oct. 11, 2018

(65) Prior Publication Data

US 2020/0118486 A1 Apr. 16, 2020

Related U.S. Application Data

(63) Continuation of application No. 15/697,221, filed on Sep. 6, 2017, now abandoned.

(Continued)

(51) Int. Cl.

| | |
|---|---|
| ***G09G 3/3216*** | (2016.01) |
| ***G09G 3/3225*** | (2016.01) |
| ***G09G 3/3233*** | (2016.01) |

(52) U.S. Cl.

CPC ..... *G09G 3/3225* (2013.01); *G09G 3/3216* (2013.01); *G09G 2320/029* (2013.01);

(Continued)

(58) Field of Classification Search

CPC .. G09G 3/3216; G09G 3/3225; G09G 3/3233; G09G 2320/029; G09G 2320/043;

(Continued)

(56) References Cited

U.S. PATENT DOCUMENTS 7,064,768 B1 * 6/2006 Bao ..... G09G 3/006 345/589

7,355,574 B1 4/2008 Leon et al.

(Continued)

OTHER PUBLICATIONS

PCT International Search Report and Written Opinion for PCT/US2018/024580, dated Jun. 21, 2018, 20 pages.

*Primary Examiner* — David Tung

(74) *Attorney, Agent, or Firm* — Fletcher Yoder, PC

(57) ABSTRACT

An electronic device comprises an electronic display having an active area having a pixel. The electronic device also comprises processing circuitry configured to receive image data to send to the pixel and adjust the image data to generate corrected image data based at least in part on a stored correction value for the pixel. The processing circuitry also is configured to generate a test data to send to the pixel subsequent to sending corrected image data to the pixel, wherein the test data is selected based upon a comparison of at least one aspect of the corrected image data with a threshold value.

20 Claims, 8 Drawing Sheets

Related U.S. Application Data

(60) Provisional application No. 62/483,237, filed on Apr. 7, 2017.

(52) U.S. Cl.
CPC ..... *G09G 2320/0233* (2013.01); *G09G 2320/0285* (2013.01); *G09G 2320/0295* (2013.01); *G09G 2320/043* (2013.01)

(58) Field of Classification Search
CPC ... G09G 2320/0285; G09G 2320/0295; G09G 2320/0233
See application file for complete search history.

(56) References Cited

U.S. PATENT DOCUMENTS

| | | | | |
|---|---|---|---|---|
| 9,520,087 | B2 | 12/2016 | Park et al. | |
| 2010/0134469 | A1 | 6/2010 | Ogura et al. | |
| 2012/0056869 | A1* | 3/2012 | Cha | G09G 3/3208 345/214 |
| 2013/0314394 | A1 | 11/2013 | Chaji et al. | |
| 2014/0253603 | A1* | 9/2014 | Kwon | G09G 3/3208 345/690 |
| 2014/0320475 | A1* | 10/2014 | Shin | G09G 3/3275 345/212 |
| 2015/0294625 | A1 | 10/2015 | Lee et al. | |
| 2015/0348463 | A1* | 12/2015 | Lee | G09G 3/3233 345/690 |
| 2016/0125796 | A1* | 5/2016 | Ohara | G09G 3/3233 345/211 |
| 2017/0032742 | A1 | 2/2017 | Piper et al. | |
| 2018/0082634 | A1 | 3/2018 | Wang et al. | |

* cited by examiner

SENSING CONSIDERING IMAGE

CROSS-REFERENCE TO RELATED APPLICATIONS

This application is a national stage filing of PCT Application No. PCT/US2018/024580, filed Mar. 27, 2018, and entitled "Sensing Considering Image," which is a continuation of and claims priority to U.S. Non-Provisional application Ser. No. 15/697,221, filed Sep. 6, 2017, and entitled "Sensing Considering Image," which claims priority to and the benefit of U.S. Provisional Application No. 62/483,237, filed on Apr. 7, 2017, and entitled "Sensing Considering Image," the disclosures of which are hereby incorporated by reference in their entireties.

BACKGROUND

The present disclosure relates generally to electronic displays and, more particularly, to devices and methods for achieving improvements in sensing attributes of a light emitting diode (LED) electronic display or attributes affecting an LED electronic display.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Flat panel displays, such as active matrix organic light emitting diode (AMOLED) displays, micro-LED (μLED) displays, and the like, are commonly used in a wide variety of electronic devices, including such consumer electronics as televisions, computers, and handheld devices (e.g., cellular telephones, audio and video players, gaming systems, and so forth). Such display panels typically provide a flat display in a relatively thin package that is suitable for use in a variety of electronic goods. In addition, such devices may use less power than comparable display technologies, making them suitable for use in battery-powered devices or in other contexts where it is desirable to minimize power usage.

LED displays typically include picture elements (e.g. pixels) arranged in a matrix to display an image that may be viewed by a user. Individual pixels of an LED display may generate light as a voltage is applied to each pixel. The voltage applied to a pixel of an LED display may be regulated by, for example, thin film transistors (TFTs). For example, a circuit switching TFT may be used to regulate current flowing into a storage capacitor, and a driver TFT may be used to regulate the voltage being provided to the LED of an individual pixel. Finally, the growing reliance on electronic devices having LED displays has generated interest in improvement of the operation of the displays.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relate to devices and methods for increased determination of the performance of certain electronic display devices including, for example, light emitting diode (LED) displays, such as organic light emitting diode (OLED) displays, active matrix organic light emitting diode (AMOLED) displays, or micro LED (μLED) displays. Under certain conditions, non-uniformity of a display induced by process non-uniformity temperature gradients, or other factors across the display should be compensated for to increase performance of a display (e.g., reduce visible anomalies). The non-uniformity of pixels in a display may vary between devices of the same type (e.g., two similar phones, tablets, wearable devices, or the like), it can vary over time and usage (e.g., due to aging and/or degradation of the pixels or other components of the display), and/or it can vary with respect to temperatures, as well as in response to additional factors.

To improve display panel uniformity, compensation techniques related to adaptive correction of the display may be employed. For example, as pixel response (e.g., luminance and/or color) can vary due to component processing, temperature, usage, aging, and the like, in one embodiment, to compensate for non-uniform pixel response, a property of the pixel (e.g., a current or a voltage) may be measured (e.g., sensed via a sensing operation) and compared to a target value, for example, stored in a lookup table or the like, to generate a correction value to be applied to correct pixel illuminations to match a desired gray level. In this manner, modified data values may be transmitted to the display to generate compensated image data (e.g., image data that accurately reflects the intended image to be displayed by adjusting for non-uniform pixel responses).

However, in some embodiments, the sensed data itself may be faulty, for example, due to hysteresis of driver TFTs of the display (e.g., a lag between a present input and a past input affecting the operation of the driver TFTs). To overcome this difficulty, active selection of reference currents or voltages may be performed. For example, the current passing through the driver TFT as an image is being displayed prior to the sensing operation may be utilized as a reference current when that current is above (or at or above) a threshold level (e.g., a predetermined reference current). Additionally, for example, use of the predetermined reference current for the sensing operation may be made when a current passing through the driver TFT is below (or at or below) a threshold level (e.g., a predetermined reference current). Additional selections of reference currents applied may be based on groups of adjacent pixels taken together to determine an average current value passing therethrough or select pixels of the group of pixels may be chosen as the basis to make the threshold determination described above. The predetermined threshold value may, in some embodiments, be dynamically selected based on one or more operational characteristics of the device or it may be set to a static level.

Various refinements of the features noted above may be made in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

Figure 1:
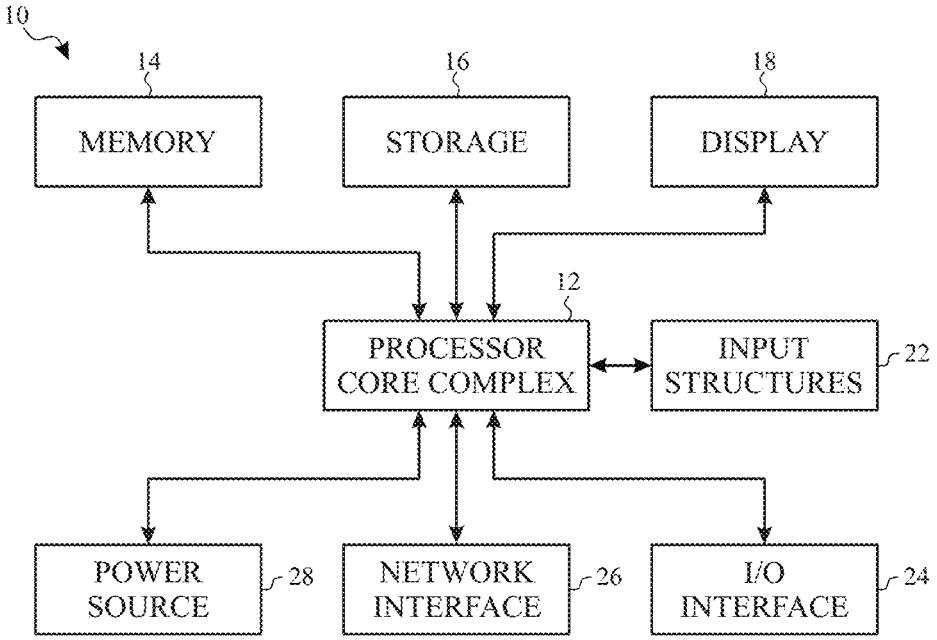
FIG. 1 is a schematic block diagram of an electronic device that performs display sensing and compensation, in accordance with an embodiment.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Furthermore, the phrase A "based on" B is intended to mean that A is at least partially based on B. Moreover, the term "or" is intended to be inclusive (e.g., logical OR) and not exclusive (e.g., logical XOR). In other words, the phrase A "or" B is intended to mean A, B, or both A and B.

Electronic displays are ubiquitous in modern electronic devices. As electronic displays gain ever-higher resolutions and dynamic range capabilities, image quality has increasingly grown in value. In general, electronic displays contain numerous picture elements, or "pixels," that are programmed with image data. Each pixel emits a particular amount of light based on the image data. By programming different pixels with different image data, graphical content including images, videos, and text can be displayed.

As noted above, display panel sensing allows for operational properties of pixels of an electronic display to be identified to improve the performance of the electronic display. For example, variations in temperature and pixel aging (among other things) across the electronic display cause pixels in different locations on the display to behave differently. Indeed, the same image data programmed on different pixels of the display could appear to be different due to the variations in temperature and pixel aging. Without appropriate compensation, these variations could produce undesirable visual artifacts. However, compensation of these variations may hinge on proper sensing of differences in the images displayed on the pixels of the display. Accordingly, the techniques and systems described below may be utilized to enhance the compensation of operational variations across the display through improvements to the generation of reference images to be sensed to determine the operational variations.

Figure 2:
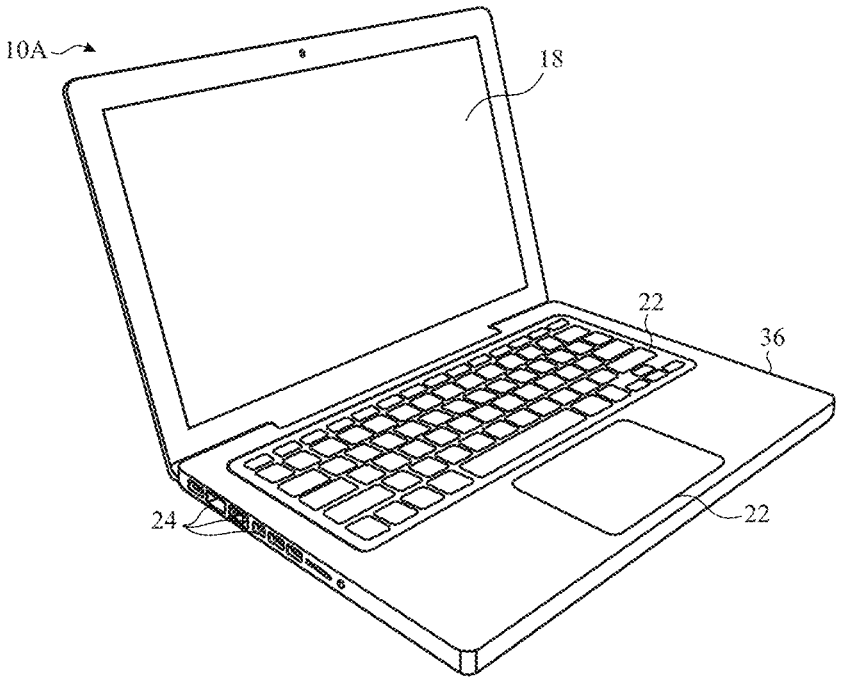
FIG. 2 is a perspective view of a notebook computer representing an embodiment of the electronic device of FIG. 1.
Figure 3:
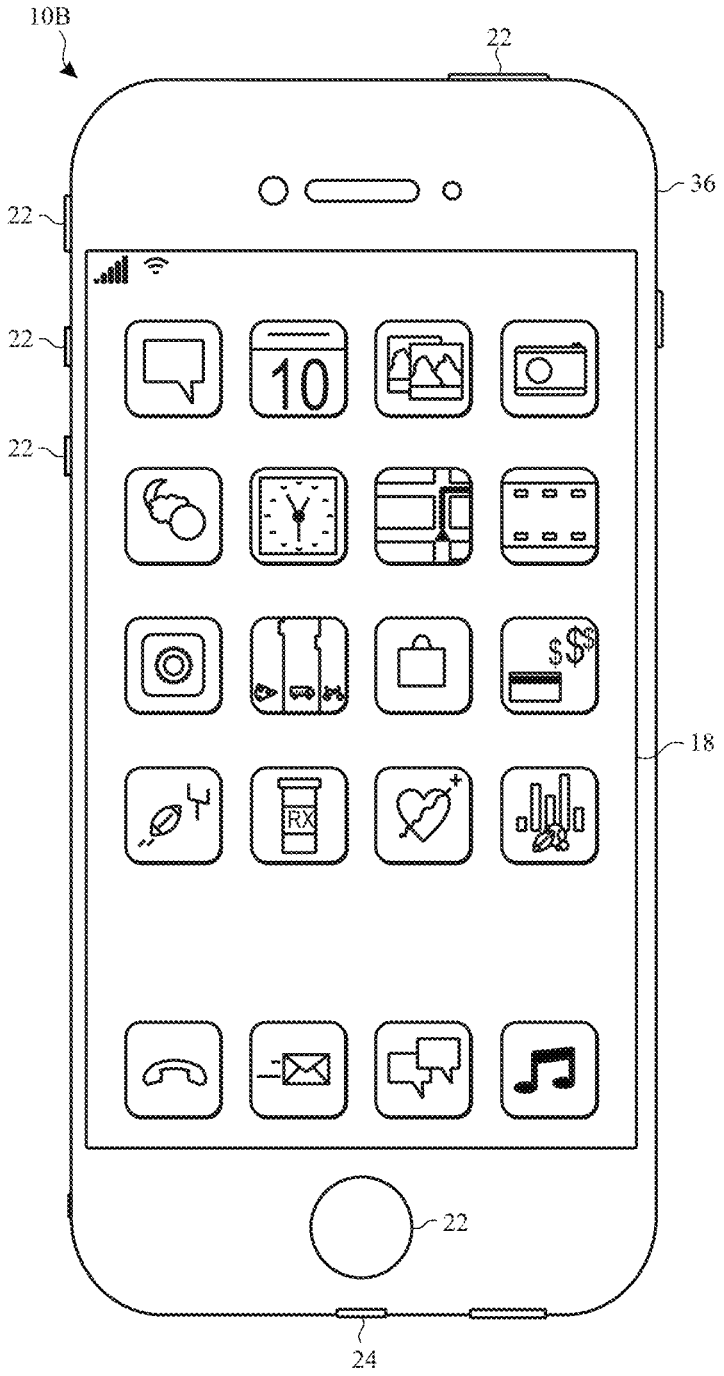
FIG. 3 is a front view of a hand-held device representing another embodiment of the electronic device of FIG. 1.
Figure 4:
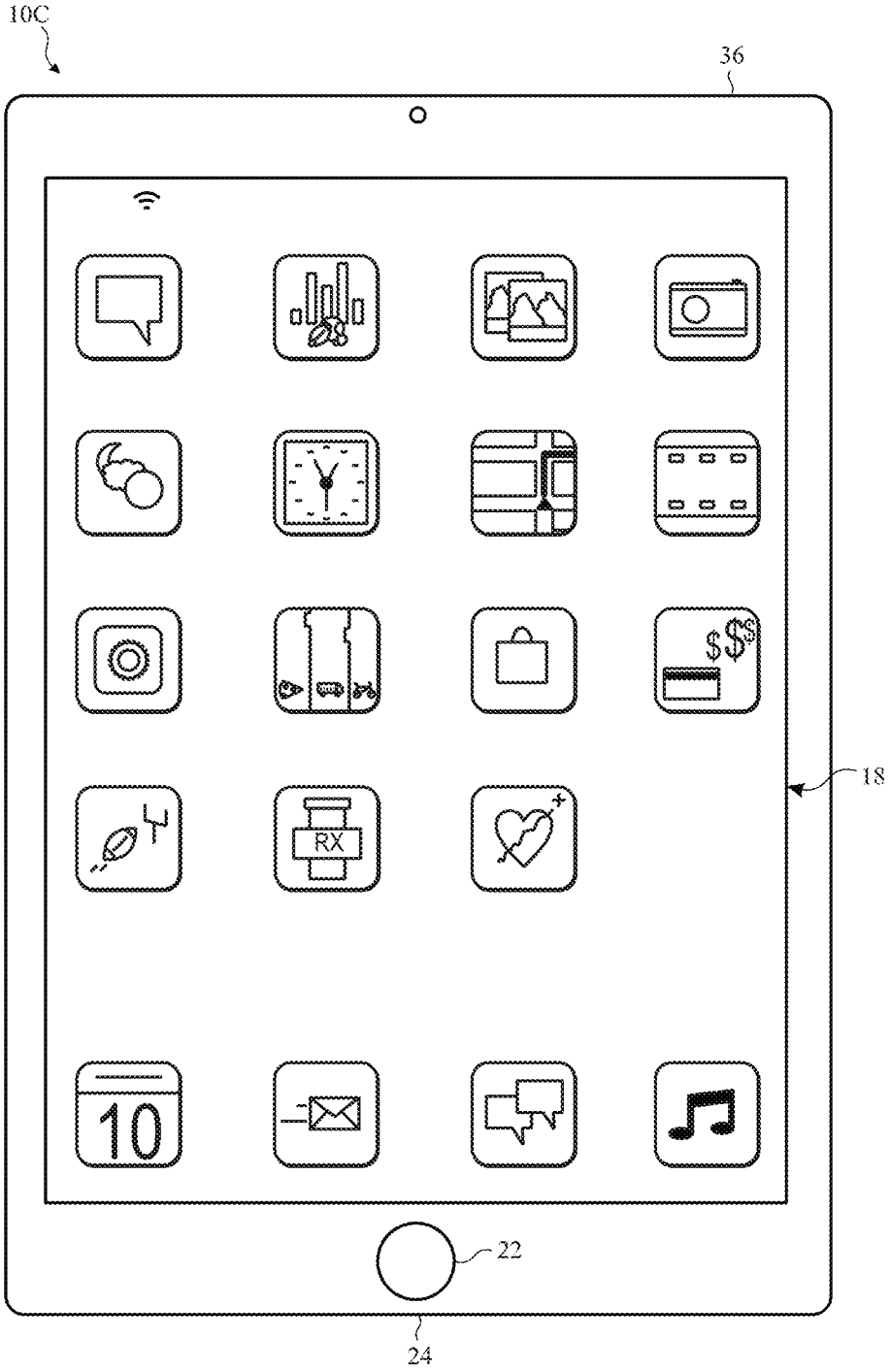
FIG. 4 is a front view of another hand-held device representing another embodiment of the electronic device of FIG. 1.
Figure 5:
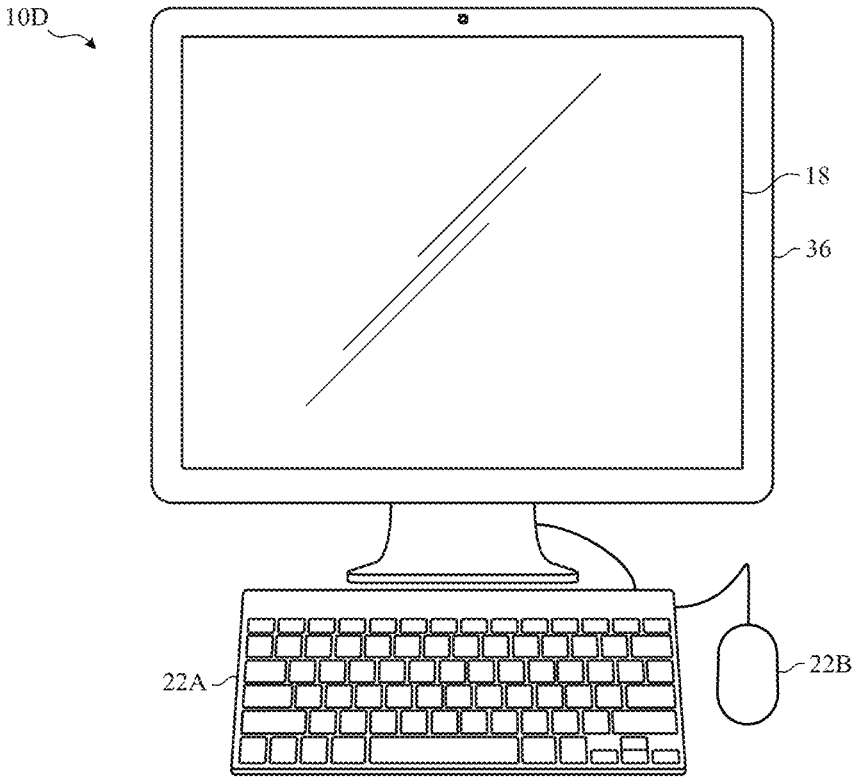
FIG. 5 is a front view of a desktop computer representing another embodiment of the electronic device of FIG. 1.
Figure 6:
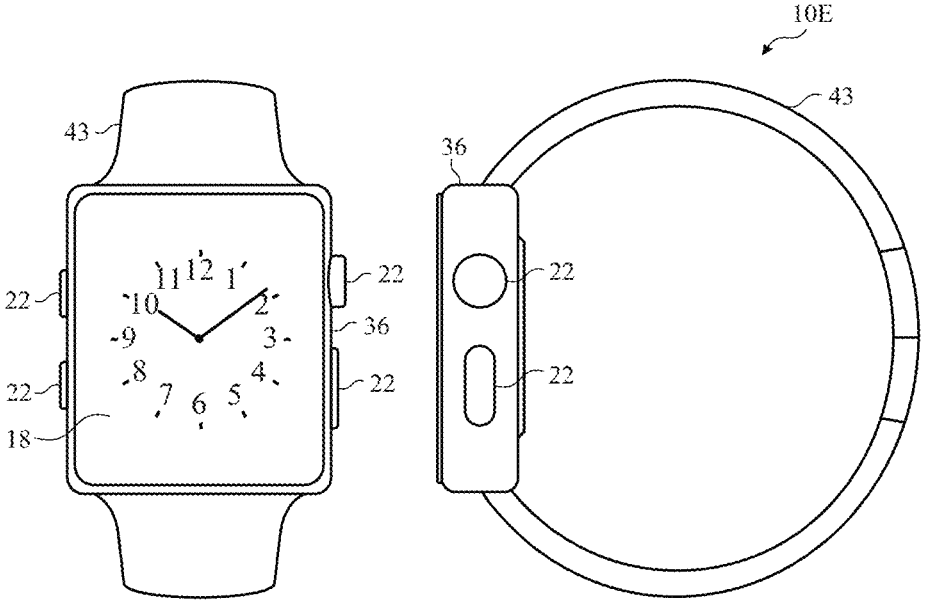
FIG. 6 is a front view and side view of a wearable electronic device representing another embodiment of the electronic device of FIG. 1.

With this in mind, a block diagram of an electronic device 10 is shown in FIG. 1. As will be described in more detail below, the electronic device 10 may represent any suitable electronic device, such as a computer, a mobile phone, a portable media device, a tablet, a television, a virtual-reality headset, a vehicle dashboard, or the like. The electronic device 10 may represent, for example, a notebook computer 10A as depicted in FIG. 2, a handheld device 10B as depicted in FIG. 3, a handheld device 10C as depicted in FIG. 4, a desktop computer 10D as depicted in FIG. 5, a wearable electronic device 10E as depicted in FIG. 6, or a similar device.

The electronic device 10 shown in FIG. 1 may include, for example, a processor core complex 12, a local memory 14, a main memory storage device 16, an electronic display 18, input structures 22, an input/output (I/O) interface 24, network interfaces 26, and a power source 28. The various functional blocks shown in FIG. 1 may include hardware elements (including circuitry), software elements (including machine-executable instructions stored on a tangible, non-transitory medium, such as the local memory 14 or the main memory storage device 16) or a combination of both hardware and software elements. It should be noted that FIG. 1 is merely one example of a particular implementation and is intended to illustrate the types of components that may be present in electronic device 10. Indeed, the various depicted components may be combined into fewer components or separated into additional components. For example, the local memory 14 and the main memory storage device 16 may be included in a single component.

The processor core complex 12 may carry out a variety of operations of the electronic device 10, such as causing the electronic display 18 to perform display panel sensing and using the feedback to adjust image data for display on the electronic display 18. The processor core complex 12 may include any suitable data processing circuitry to perform these operations, such as one or more microprocessors, one or more application specific processors (ASICs), or one or more programmable logic devices (PLDs). In some cases, the processor core complex 12 may execute programs or instructions (e.g., an operating system or application program) stored on a suitable article of manufacture, such as the local memory 14 and/or the main memory storage device 16. In addition to instructions for the processor core complex 12, the local memory 14 and/or the main memory storage device 16 may also store data to be processed by the processor core complex 12. By way of example, the local memory 14 may include random access memory (RAM) and the main memory storage device 16 may include read only memory (ROM), rewritable non-volatile memory such as flash memory, hard drives, optical discs, or the like.

The electronic display 18 may display image frames, such as a graphical user interface (GUI) for an operating system or an application interface, still images, or video content. The processor core complex 12 may supply at least some of the image frames. The electronic display 18 may be a self-emissive display, such as an organic light emitting diodes (OLED) display, or may be a liquid crystal display (LCD) illuminated by a backlight. In some embodiments, the electronic display 18 may include a touch screen, which may allow users to interact with a user interface of the electronic device 10. The electronic display 18 may employ display panel sensing to identify operational variations of the electronic display 18. This may allow the processor core complex 12 to adjust image data that is sent to the electronic display 18 to compensate for these variations, thereby improving the quality of the image frames appearing on the electronic display 18.

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interface 26. The network interface 26 may include, for example, interfaces for a personal area network (PAN), such as a Bluetooth network, for a local area network (LAN) or wireless local area network (WLAN), such as an 802.11x Wi-Fi network, and/or for a wide area network (WAN), such as a cellular network. The network interface 26 may also include interfaces for, for example, broadband fixed wireless access networks (WiMAX), mobile broadband Wireless networks (mobile WiMAX), asynchronous digital subscriber lines (e.g., ADSL, VDSL), digital video broadcasting-terrestrial (DVB-T) and its extension DVB Handheld (DVB-H), ultra wideband (UWB), alternating current (AC) power lines, and so forth. The power source 28 may include any suitable source of power, such as a rechargeable lithium polymer (Li-poly) battery and/or an alternating current (AC) power converter.

In certain embodiments, the electronic device 10 may take the form of a computer, a portable electronic device, a wearable electronic device, or other type of electronic device. Such computers may include computers that are generally portable (such as laptop, notebook, and tablet computers) as well as computers that are generally used in one place (such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 10A, is illustrated in FIG. 2 in accordance with one embodiment of the present disclosure. The depicted computer 10A may include a housing or enclosure 36, an electronic display 18, input structures 22, and ports of an I/O interface 24. In one embodiment, the input structures 22 (such as a keyboard and/or touchpad) may be used to interact with the computer 10A, such as to start, control, or operate a GUI or applications running on computer 10A. For example, a keyboard and/or touchpad may allow a user to navigate a user interface or application interface di splayed on the electronic di splay 18.

FIG. 3 depicts a front view of a handheld device 10B, which represents one embodiment of the electronic device 10. The handheld device 10B may represent, for example, a portable phone, a media player, a personal data organizer, a handheld game platform, or any combination of such devices. By way of example, the handheld device 10B may be a model of an iPod® or iPhone® available from Apple Inc. of Cupertino, Calif. The handheld device 10B may include an enclosure 36 to protect interior components from physical damage and to shield them from electromagnetic interference. The enclosure 36 may surround the electronic display 18. The I/O interfaces 24 may open through the enclosure 36 and may include, for example, an I/O port for a hard wired connection for charging and/or content manipulation using a standard connector and protocol, such as the Lightning connector provided by Apple Inc., a universal service bus (USB), or other similar connector and protocol.

User input structures 22, in combination with the electronic display 18, may allow a user to control the handheld device 10B. For example, the input structures 22 may activate or deactivate the handheld device 10B, navigate user interface to a home screen, a user-configurable application screen, and/or activate a voice-recognition feature of the handheld device 10B. Other input structures 22 may provide volume control, or may toggle between vibrate and ring modes. The input structures 22 may also include a microphone may obtain a user's voice for various voice-related features, and a speaker may enable audio playback and/or certain phone capabilities. The input structures 22 may also include a headphone input may provide a connection to external speakers and/or headphones.

FIG. 4 depicts a front view of another handheld device 10C, which represents another embodiment of the electronic device 10. The handheld device 10C may represent, for example, a tablet computer or portable computing device. By way of example, the handheld device 10C may be a tablet-sized embodiment of the electronic device 10, which may be, for example, a model of an iPad® available from Apple Inc. of Cupertino, Calif.

Turning to FIG. 5, a computer 10D may represent another embodiment of the electronic device 10 of FIG. 1. The computer 10D may be any computer, such as a desktop computer, a server, or a notebook computer, but may also be a standalone media player or video gaming machine. By way of example, the computer 10D may be an iMac®, a MacBook®, or other similar device by Apple Inc. It should be noted that the computer 10D may also represent a personal computer (PC) by another manufacturer. A similar enclosure 36 may be provided to protect and enclose internal components of the computer 10D such as the electronic display 18. In certain embodiments, a user of the computer 10D may interact with the computer 10D using various peripheral input devices, such as input structures 22A or 22B (e.g., keyboard and mouse), which may connect to the computer 10D.

Similarly, FIG. 6 depicts a wearable electronic device 10E representing another embodiment of the electronic device 10 of FIG. 1 that may be configured to operate using the techniques described herein. By way of example, the wearable electronic device 10E, which may include a wristband 43, may be an Apple Watch® by Apple, Inc. However, in other embodiments, the wearable electronic device 10E may include any wearable electronic device such as, for example, a wearable exercise monitoring device (e.g., pedometer, accelerometer, heart rate monitor), or other device by another manufacturer. The electronic display 18 of the wearable electronic device 10E may include a touch screen display 18 (e.g., LCD, OLED display, active-matrix organic light emitting diode (AMOLED) display, and so forth), as well as input structures 22, which may allow users to interact with a user interface of the wearable electronic device 10E.

Figure 7:
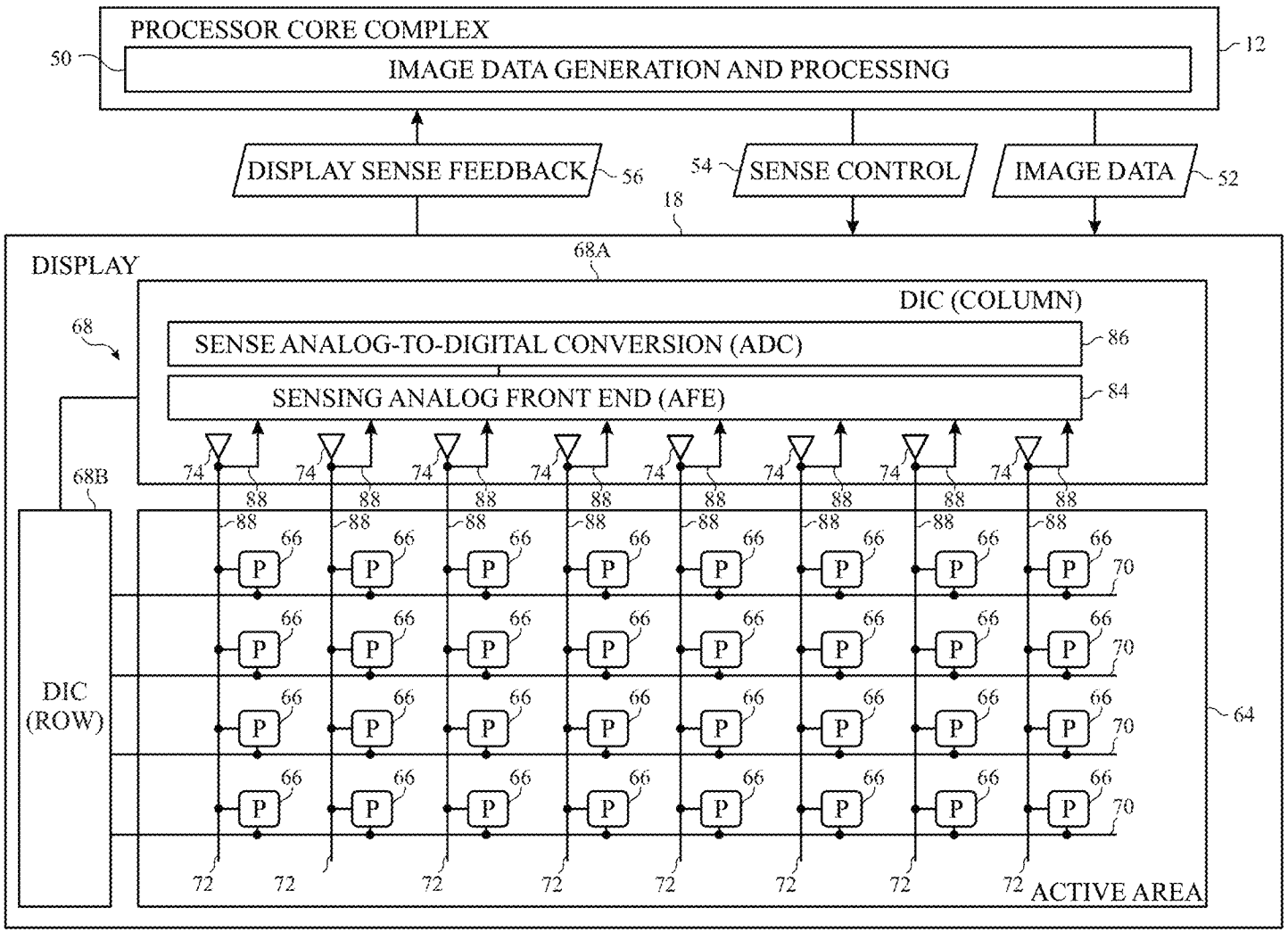
FIG. 7 is a block diagram of an electronic display of FIG. 1 that performs display panel sensing, in accordance with an embodiment.

As shown in FIG. 7, in the various embodiments of the electronic device 10, the processor core complex 12 may perform image data generation and processing circuitry 50 to generate image data 52 for display by the electronic display 18. The image data generation and processing circuitry 50 of the processor core complex 12 is meant to represent the various circuitry and processing that may be employed by the core processor 12 to generate the image data 52 and control the electronic display 18. As illustrated, the image data generation and processing circuitry 50 may externally coupled to the electronic display 18. However, in other embodiments, the image data generation and processing circuitry 50 may be part of the display 12. In some embodiments, the image data generation and processing circuitry 50 may represent a graphics processing unit, a display pipeline, or the like and to facilitate control of operation of the electronic display 18. The image data generation and processing circuitry 50 may include a processor and memory such that the processor of the image data generation and processing circuitry 50 may execute instructions and/or process data stored in memory of the image data generation and processing circuitry 50 to control operation in the electronic display 12.

As previously discussed, since it may be desirable to compensate for image data 52, for example, based on manufacturing and/or operational variations of the electronic display 18, the processor core complex 12 may provide sense control signals 54 to cause the electronic display 18 to perform display panel sensing to generate display sense feedback 56. The display sense feedback 56 represents digital information relating to the operational variations of the electronic display 18. The display sense feedback 56 may take any suitable form, and may be converted by the image data generation and processing circuitry 50 into a compensation value that, when applied to the image data 52, appropriately compensates the image data 52 for the conditions of the electronic display 18. This results in greater fidelity of the image data 52, reducing or eliminating visual artifacts that would otherwise occur due to the operational variations of the electronic display 18.

The electronic display 18 includes an active area 64 with an array of pixels 66. The pixels 66 are schematically shown distributed substantially equally apart and of the same size, but in an actual implementation, pixels of different colors may have different spatial relationships to one another and may have different sizes. In one example, the pixels 66 may take a red-green-blue (RGB) format with red, green, and blue pixels, and in another example, the pixels 66 may take a red-green-blue-green (RGBG) format in a diamond pattern. The pixels 66 are controlled by a driver integrated circuit 68, which may be a single module or may be made up of separate modules, such as a column driver integrated circuit 68A and a row driver integrated circuit 68B. The driver integrated circuit 68 (e.g., 68B) may send signals across gate lines 70 to cause a row of pixels 66 to become activated and programmable, at which point the driver integrated circuit 68 (e.g., 68A) may transmit image data signals across data lines 72 to program the pixels 66 to display a particular gray level (e.g., individual pixel brightness). By supplying different pixels 66 of different colors with image data to display different gray levels, full-color images may be programmed into the pixels 66. The image data may be driven to an active row of pixel 66 via source drivers 74, which are also sometimes referred to as column drivers.

As described above, display 18 may display image frames through control of its luminance of its pixels 66 based at least in part on received image data. When a pixel 66 is activated (e.g., via a gate activation signal across a gate line 70 activating a row of pixels 66), luminance of a display pixel 66 may be adjusted by image data received via a data line 72 coupled to the pixel 66. Thus, as depicted, each pixel 66 may be located at an intersection of a gate line 70 (e.g., a scan line) and a data line 72 (e.g., a source line). Based on received image data, the display pixel 40 may adjust its luminance using electrical power supplied from a power supply 38, for example, via power a supply lines coupled to the pixel 66.

Figure 8:
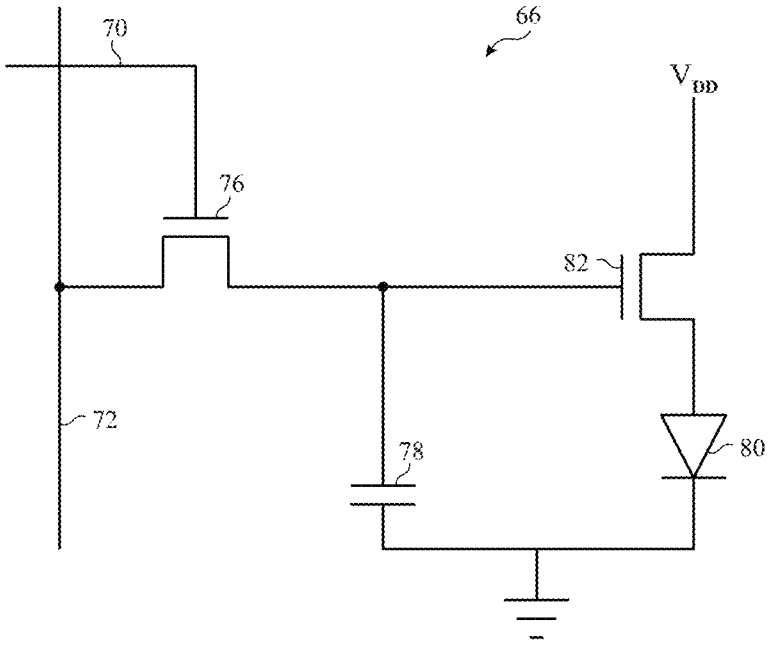
FIG. 8 is a block diagram of a pixel of the electronic display of FIG. 7, in accordance with an embodiment.

As illustrated in FIG. 8, each pixel 66 may include a circuit switching thin-film transistor (TFT) 76, a storage capacitor 78, an LED 80, and a driver TFT 82 (whereby each of the storage capacitor 78 and the LED 80 may be coupled to a common voltage, Vcom or ground). However, variations may be utilized in place of illustrated pixel 66 of FIG. 8. To facilitate adjusting luminance, the driver TFT 82 and the circuit switching TFT 76 may each serve as a switching device that is controllably turned on and off by voltage applied to its respective gate. In the depicted embodiment, the gate of the circuit switching TFT 76 is electrically coupled to a gate line 70. Accordingly, when a gate activation signal received from its gate line 70 is above its threshold voltage, the circuit switching TFT 76 may turn on, thereby activating the pixel 66 and charging the storage capacitor 78 with image data received at its data line 72.

Additionally, in the depicted embodiment, the gate of the driver TFT 82 is electrically coupled to the storage capacitor 78. As such, voltage of the storage capacitor 78 may control operation of the driver TFT 82. More specifically, in some embodiments, the driver TFT 82 may be operated in an active region to control magnitude of supply current flowing through the LED 80 (e.g., from a power supply or the like providing Vdd). In other words, as gate voltage (e.g., storage capacitor 78 voltage) increases above its threshold voltage, the driver TFT 82 may increase the amount of its channel available to conduct electrical power, thereby increasing supply current flowing to the LED 80. On the other hand, as the gate voltage decreases while still being above its threshold voltage, the driver TFT 82 may decrease amount of its channel available to conduct electrical power, thereby decreasing supply current flowing to the LED 80. In this manner, the luminance of the pixel 66 may be controlled and, when similar techniques are applied across the display 18 (e.g., to the pixels 66 of the display 18), an image may be displayed.

As mentioned above, the pixels 66 may be arranged in any suitable layout with the pixels 66 having various colors and/or shapes. For example, the pixels 66 may appear in alternating red, green, and blue in some embodiments, but also may take other arrangements. The other arrangements may include, for example, a red-green-blue-white (RGBW) layout or a diamond pattern layout in which one column of pixels alternates between red and blue and an adjacent column of pixels are green. Regardless of the particular arrangement and layout of the pixels 66, each pixel 66 may be sensitive to changes on the active area of 64 of the electronic display 18, such as variations and temperature of the active area 64, as well as the overall age of the pixel 66. Indeed, when each pixel 66 is a light emitting diode (LED), it may gradually emit less light over time. This effect is referred to as aging, and takes place over a slower time period than the effect of temperature on the pixel 66 of the electronic display 18.

Returning to FIG. 7, display panel sensing may be used to obtain the display sense feedback 56, which may enable the processor core complex 12 to generate compensated image data 52 to negate the effects of temperature, aging, and other variations of the active area 64. The driver integrated circuit 68 (e.g., 68A) may include a sensing analog front end (AFE) 84 to perform analog sensing of the response of pixels 66 to test data. The analog signal may be digitized by sensing analog-to-digital conversion circuitry (ADC) 86.

For example, to perform display panel sensing, the electronic display 18 may program one of the pixels 66 with test data (e.g., having a particular reference voltage or reference current). The sensing analog front end 84 then senses (e.g., measures, receives, etc.) at least one value (e.g., voltage, current, etc.) alone sense line 88 of connected to the pixel 66 that is being tested. Here, the data lines 72 are shown to act as extensions of the sense lines 88 of the electronic display 18. In other embodiments, however, the display active area 64 may include other dedicated sense lines 88 or other lines of the display 18 may be used as sense lines 88 instead of the data lines 72. In some embodiments, other pixels 66 that have not been programmed with test data may be also sensed at the same time a pixel 66 that has been programmed with test data is sensed. Indeed, by sensing a reference signal on a sense line 88 when a pixel 66 on that sense line 88 has not been programmed with test data, a common-mode noise reference value may be obtained. This reference signal can be removed from the signal from the test pixel 66 that has been programmed with test data to reduce or eliminate common mode noise.

The analog signal may be digitized by the sensing analog-to-digital conversion circuitry 86. The sensing analog front end 84 and the sensing analog-to-digital conversion circuitry 86 may operate, in effect, as a single unit. The driver integrated circuit 68 (e.g., 68A) may also perform additional digital operations to generate the display feedback 56, such as digital filtering, adding, or subtracting, to generate the display feedback 56, or such processing may be performed by the processor core complex 12.

In some embodiments, a correction map (e.g., stored as a look-up table or the like) that may include correction values that correspond to or represent offsets or other values applied to generated compensated image data 52 being transmitted to the pixels 66 to correct, for example, for temperature differences at the display 18 or other characteristics affecting the uniformity of the display 18. This correction map may be part of the image data generation and processing circuit (e.g., stored in memory therein) or it may be stored in, for example, memory 14 or storage 16. Through the use of the correction map (i.e., the correction information stored therein), effects of the variation and non-uniformity in the display 18 may be corrected using the image data generation and processing circuitry 50 of the processor core complex 12. The correction map, in some embodiments, correspond to the entire active area 64 of the display 18 or a sub-segment of the active area 64. For example, to reduce the size of the memory required to store the correction map (or the data therein), the correction map may include correction values that correspond to only to predetermined groups or regions of the active area 64, whereby one or more correction values may be applied to the group of pixels 66. Additionally, in some embodiments, the correction map be a reduced resolution correction map that enables low power and fast response operations such that, for example, the image data generation and processing circuitry 50 may reduce the resolution of the correction values prior to their storage in memory so that less memory may be required, responses may be accelerated, and the like. Additionally, adjustment of the resolution of the correction map may be dynamic and/or resolution of the correction map may be locally adjusted (e.g., adjusted at particular locations corresponding to one or more regions or groups of pixels 66).

The correction map (or a portion thereof, for example, data corresponding to a particular region or group of pixels 66), may be read from the memory of the image data generation and processing circuitry 50. The correction map (e.g., one or more correction values) may then (optionally) be scaled, whereby the scaling corresponds to (e.g., offsets or is the inverse of) a resolution reduction that was applied to the correction map. In some embodiments, whether this scaling is performed (and the level of scaling) may be based on one or more input signals received as display settings and/or system information by the image data generation and processing circuitry 50.

Conversion of the correction map may be undertaken via interpolation (e.g., Gaussian, linear, cubic, or the like), extrapolation (e.g., linear, polynomial, or the like), or other conversion techniques being applied to the data of the correction map. This may allow for accounting of, for example, boundary conditions of the correction map and may yield compensation driving data that may be applied to raw display content (e.g., image data) so as to generate compensated image data 52 that is transmitted to the pixels 66.

In some embodiments, the correction map may be updated, for example, based on input values generated from the display sense feedback 56 by the image data generation and processing circuitry 50. This updating of the correction map may be performed globally (e.g., affecting the entirety of the correction map) and/or locally (e.g., affecting less than the entirety of the correction map). The update may be based on real time measurements of the active area 64 of the electronic display 18, transmitted as display sense feedback 56. Additionally and/or alternatively, a variable update rate of correction can be chosen, e.g., by the image data generation and processing system 50, based on conditions affecting the display 18 (e.g., display 18 usage, power level of the device, environmental conditions, or the like).

Figure 9:
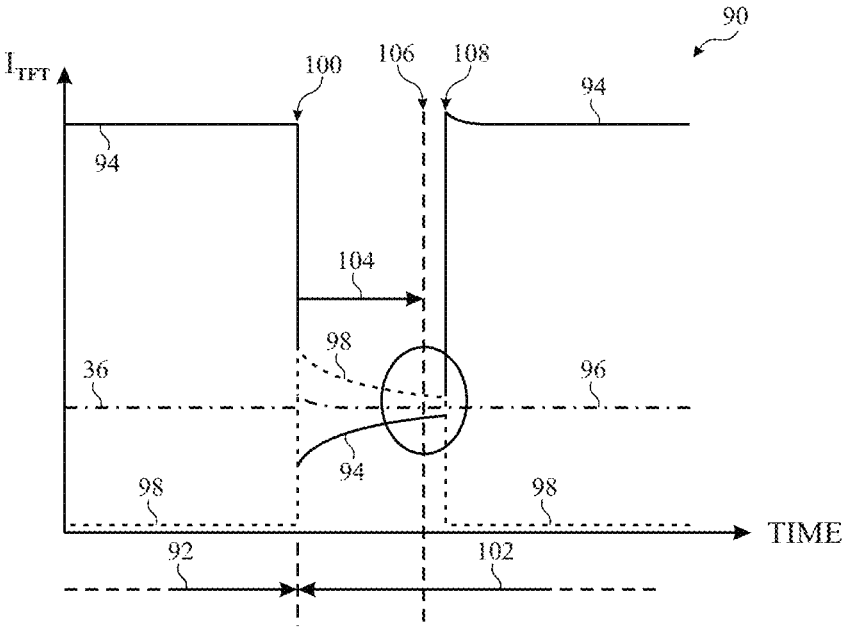
FIG. 9 is a graphical example of updating a correction map of the electronic display of FIG. 7, in accordance with an embodiment.

FIG. 9 illustrates a graphical example of a technique for updating of the correction map. As shown in graph 90, during frame 92 (e.g., represented by n-1), a current 94 passing through the driver TFT 82 may correspond to a brightness level (e.g., a gray level) above a threshold current value 96 (e.g., current 94 may correspond to a gray level or desired gray level for a pixel 66 above a reference gray level value that corresponds to threshold current value 96). For example, the current 94 may represent the current applied through the driver TFT 82 and transmitted to the LED 80 to generate a relatively bright portion of an image during frame 92. Also illustrated in graph 90 is a current 98 passing through the driver TFT 82, which illustrates an example of a different current than current 94 previously discussed, where only one of current 94 or current 98 is applied during frame 92. The current 98 may correspond to a brightness level (e.g., a gray level) below a threshold current value 96 (e.g., current 98 may correspond to a gray level or desired gray level for a pixel 66 below a reference gray level value that corresponds to threshold current value 96). Current 98 may represent the current applied through the driver TFT 82 and transmitted to the LED 80 to generate a relatively dark portion of an image during frame 92.

As illustrated at time 100, the first frame 92 is completed and a second frame 102 (which may be referred to as frame n and may, for example, correspond to a frame refresh) begins. However, in other embodiments, frame 102 may begin at time 108 (discussed below) and, accordingly, the time between frame 92 and 102 may be considered a sensing frame (e.g., separate from frame 102 instead of part of frame 102). At time 100, a display panel sensing operation may begin whereby, for example, the processor core complex 12 (or a portion thereof, such as image data generation and processing circuitry 50) may provide sense control signals 54 to cause the electronic display 18 to perform display panel sensing to generate display sense feedback 56. These sense control signals 54 may be used to program one of the pixels 66 with test data (e.g., having a particular reference voltage or reference current). For the purposes of discussion, test currents will be sensed as part of the display panel sensing operation, however, it is understood that the display panel sensing operation may instead operate to sense voltage levels from one of more components of the pixels 66, current levels from one or more components of the pixels 66, brightness of the LED 80, or any combination thereof based on test data supplied to the pixels 66.

As illustrated, when the test data is applied to a pixel 66, hysteresis (e.g., a lag between a present input and a past input affecting operation) of, for example, the driver TFT 82 of the pixel 66 or one or more transient conditions affecting the pixel 66 or one or more component therein can cause a transient state wherein the current to be sensed has not reached a steady state (e.g., such that measurements of the currents at this time would affect their reliability). For example, at time 100 as the pixel is programed with test data, when the pixel 66 previously had a driver TFT current 94 corresponding to a relatively high gray level, this current 94 swings below the threshold current value 96 corresponding to the test data gray level value. The driver TFT current 94 may continue to move towards a steady state. In some embodiments, the amount of time that the current 94 of the driver TFT 82 has to settle (e.g., the relaxation time) is illustrated as time period 104 which represents the time between time 100 and time 106 corresponding to a sensing of the current (e.g., the driver TFT 82 current). Time period 104 may be, for example, less than approximately 10 microseconds (μs), 20 μs, 30 μs, 40 μs, 50 μs, 75 μs, 100 μs, 200 μs, 300 μs, 400 μs, 500 μs, or a similar value. At time 108, the pixel 66 may be programmed again with a data value, returning the current 94 to its original level (assuming the data signal has not changed between frame 92 and frame 102).

Likewise, at time 100 as the pixel is programed with test data, when the pixel 66 previously had a driver TFT current 98 corresponding to a relatively low gray level, this current 98 swings above the threshold current value 96 corresponding to the test data gray level value. The driver TFT current 94 may continue to move towards a steady state. In some embodiments, the amount of time that the current 98 of the driver TFT 82 has to settle (e.g., the relaxation time) is illustrated as time period 104. At time 108, the pixel 66 may be programmed again with a data value, returning the current 98 to its original level (assuming the data signal has not changed between frame 92 and frame 102).

As illustrated, the a technique for updating of the correction map illustrated in graph 90 in conjunction with a display panel sensing operation includes a double sided error (e.g., current 94 swinging below the threshold current value 96 corresponding to the test data gray level value and current 98 swinging above the threshold current value 96 corresponding to the test data gray level value) during time period 104. However, techniques may be applied to reduce the double sided error present in FIG. 9.

Figure 10:
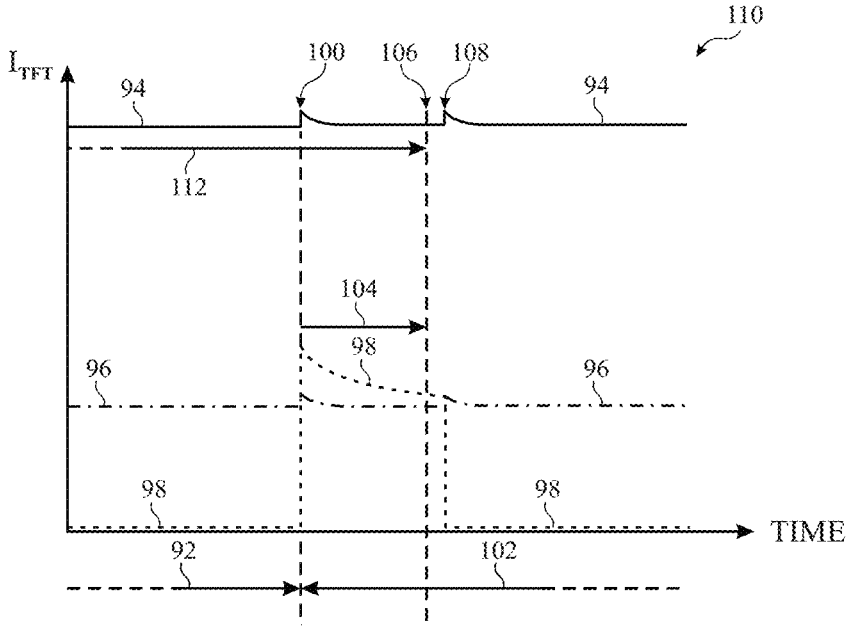
FIG. 10 is a second graphical example of updating a correction map of the electronic display of FIG. 7, in accordance with an embodiment.

For example, FIG. 10 illustrates a graphical representation (e.g., graph 110) of a technique for updating of the correction map having only a single sided error present. As shown in graph 110, during frame 92, a current 94 passing through the driver TFT 82 may correspond to a brightness level (e.g., a gray level) above a threshold current value 96 (e.g., current 94 may correspond to a gray level or desired gray level for a pixel 66 above a reference gray level value that corresponds to threshold current value 96). For example, the current 94 may represent the current applied through the driver TFT 82 and transmitted to the LED 80 to generate a relatively bright portion of an image during frame 92. Also illustrated in graph 90 is a current 98 passing through the driver TFT 82, which illustrates an example of a different current than current 94 previously discussed, where only one of current 94 or current 98 is applied during frame 92. The current 98 may correspond to a brightness level (e.g., a gray level) below a threshold current value 96 (e.g., current 98 may correspond to a gray level or desired gray level for a pixel 66 below a reference gray level value that corresponds to threshold current value 96). Current 98 may represent the current applied through the driver TFT 82 and transmitted to the LED 80 to generate a relatively dark portion of an image during frame 92.

As illustrated at time 100, the first frame 92 is completed and a second frame 102 (which, for example, may correspond to a frame refresh) begins. At time 100, a display panel sensing operation may begin whereby, for example, the processor core complex 12 (or a portion thereof, such as image data generation and processing circuitry 50) may provide sense control signals 54 to cause the electronic display 18 to perform display panel sensing to generate display sense feedback 56. These sense control signals 54 may be used to program one of the pixels 66 with test data (e.g., having a particular reference voltage or reference current). For the purposes of discussion, test currents will be sensed as part of the display panel sensing operation, however, it is understood that the display panel sensing operation may instead operate to sense voltage levels from one of more components of the pixels 66, current levels from one or more components of the pixels 66, brightness of the LED 80, or any combination thereof based on test data supplied to the pixels 66.

As illustrated, the processor core complex 12 (or a portion thereof, such as image data generation and processing circuitry 50) may dynamically provide sense control signals 54 to cause the electronic display 18 to perform display panel sensing to generate display sense feedback 56. For example, the processor core complex 12 (or a portion thereof, such as image data generation and processing circuitry 50) may determine whether, in frame 92, the current 94 corresponds to a gray level or desired gray level for a pixel 66 above (or at or above) a reference gray level value that corresponds to threshold current value 96. Alternatively, the processor core complex 12 (or a portion thereof, such as image data generation and processing circuitry 50) may determine whether, in frame 92, the gray level or desired gray level for a pixel 66 is above (or at or above) a reference gray level value that corresponds to threshold current value 96. If the current 94 in frame 92 corresponds to a gray level or desired gray level for a pixel 66 above (or at or above) a reference gray level value corresponding to threshold current value 96, or if the gray level or desired gray level for a pixel 66 in frame 92 is above (or at or above) a reference gray level value corresponding to threshold current value 96, the processor core complex 12 (or a portion thereof, such as image data generation and processing circuitry 50) may produce and provide sense control signals 54 (e.g., test data) corresponding to the gray level or desired gray level of the pixel in frame 92 such that the current level to be sensed at time 106 is equivalent to the current level of the TFT driver 82 during frame 92. This allows for a time period 112 that the current 94 of the driver TFT 82 has to settle (e.g., the relaxation time) which represents the time between the start of frame 92 and time 106 corresponding to a sensing of the current (e.g., the driver TFT 82 current). Time period 112 may be, for example, less than approximately 20 milliseconds (ms), 15 ms, 10 ms, 9 ms, 8 ms, 7, ms, 6 ms, 5 ms, or a similar value.

As additionally illustrated in FIG. 10, at time 100 (as the pixel is programed with test data), when the pixel 66 previously had a driver TFT current 98 corresponding to a relatively low gray level, this current 98 swings above the threshold current value 96 corresponding to the test data gray level value. The driver TFT current 94 may continue to move towards a steady state. In some embodiments, the amount of time that the current 98 of the driver TFT has to settle (e.g., the relaxation time) is illustrated as time period 104. At time 108, the pixel 66 may be programmed again with a data value, returning the current 98 to its original level (assuming the data signal has not changed between frame 92 and frame 102). However, as illustrated in FIG. 10 and described above, through dynamic selection of test data sent to the pixel 66 (e.g., differential sensing using separate test data based on the operation of a pixel 66 in a frame 92), double sided errors illustrated in FIG. 9 may be reduced to single sided errors in FIG. 10, thus allowing for more accurate readings (sensed data) to be retrieved as display sense feedback 56, which allows for increased accuracy in the correction values calculated, stored (e.g., in a correction map), and/or applied as compensated image data 52. The single sided errors of FIG. 10 may be illustrative of, for example, hysteresis caused by a change of the gate-source voltage of the driver TFT 82 when sensing programming of a pixel 66 at time 100 alters the gray level corresponding to current 98 to a gray level corresponding to the threshold current value 96, whereby the hysteresis may be proportional to a change in the gate-source voltage of the driver TFT 82.

Figure 11:
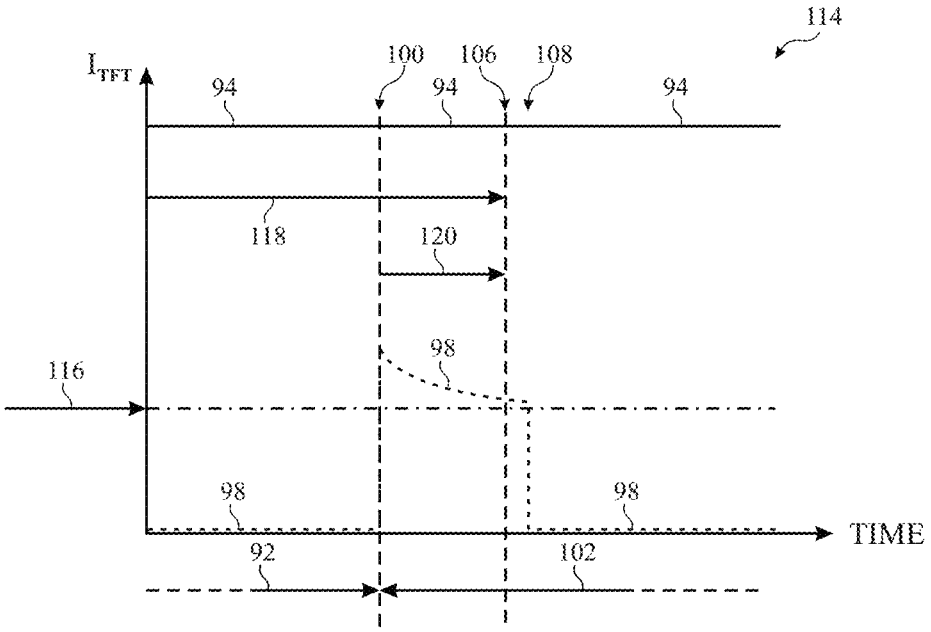
FIG. 11 is a third graphical example of updating a correction map of the electronic display of FIG. 7, in accordance with an embodiment.

In some embodiments, further reduction of sensing errors (e.g., errors due to the sensed current not being able to reach or not being able to nearly reach a steady state) may also be reduced for example, through selection of test data having a gray level corresponding to a threshold current value differing from threshold current value 96. FIG. 11 illustrates a second graphical representation (e.g., graph 114) of a technique for updating of the correction map having only a single sided error present. As shown in graph 110, during frame 92, a current 94 passing through the driver TFT 82 may correspond to a brightness level (e.g., a gray level) above a threshold current value 116 (e.g., current 94 may correspond to a gray level or desired gray level for a pixel 66 above a reference gray level value that corresponds to threshold current value 116).

Current value 116 may be, for example, initially set at a predetermined level based upon, for example, an initial configuration of the device 10 (e.g., at the factory and/or during initial device 10 or display 18 testing) or may be dynamically performed and set (e.g., at predetermined intervals or in response to a condition, such as startup of the device). The current value 116 may be selected to correspond to the lowest gray level or desired gray level for a pixel 66 having a predetermined or desired reliability, a predetermined or desired signal to noise ratio (SNR), or the like. Alternatively, the current value 116 may be selected to correspond to a gray level within 2%, 5%, 10%, or another value the lowest gray level or desired gray level for a pixel 66 having a predetermined or desired reliability, a predetermined or desired SNR, or the like. For example, selection of a current value 116 corresponding to a gray level 0 may introduce too much noise into any sensed current value. However, each device 10 may have a gray level (e.g., gray level 10, 15, 20, 20, 30, or another level) at which a predetermined or desired reliability, a predetermined or desired SNR, or the like may be achieved and this gray value (or a gray value within a percentage value above the minimum gray level if, for example, a buffer regarding the reliability, SNR, or the like is desirable) may be selected for test data, which corresponds to threshold current value 116. In some embodiments, the test data, which corresponds to threshold current value 116, can also be altered based on results from the sensing operation (e.g., altered in a manner similar to the alteration of the compensated image data 52).

Thus, as illustrated in FIG. 11, the current 94 may represent the current applied through the driver TFT 82 and transmitted to the LED 80 to generate a relatively bright portion of an image during frame 92. Also illustrated in graph 114 is a current 98 passing through the driver TFT 82, which illustrates an example of a different current than current 94 previously discussed, where only one of current 94 or current 98 is applied during frame 92. The current 98 may correspond to a brightness level (e.g., a gray level) below the threshold current value 116 (e.g., current 98 may correspond to a gray level or desired gray level for a pixel 66 below a reference gray level value that corresponds to threshold current value 116). Current 98 may represent the current applied through the driver TFT 82 and transmitted to the LED 80 to generate a relatively dark portion of an image during frame 92.

As illustrated at time 100, the first frame 92 is completed and a second frame 102 (which, for example, may correspond to a frame refresh) begins. At time 100, a display panel sensing operation may begin whereby, for example, the processor core complex 12 (or a portion thereof, such as image data generation and processing circuitry 50) may provide sense control signals 54 to cause the electronic display 18 to perform display panel sensing to generate display sense feedback 56. These sense control signals 54 may be used to program one of the pixels 66 with test data (e.g., having a particular reference voltage or reference current). For the purposes of discussion, test currents will be sensed as part of the display panel sensing operation, however, it is understood that the display panel sensing operation may instead operate to sense voltage levels from one of more components of the pixels 66, current levels from one or more components of the pixels 66, brightness of the LED 80, or any combination thereof based on test data supplied to the pixels 66.

As illustrated, the processor core complex 12 (or a portion thereof, such as image data generation and processing circuitry 50) may dynamically provide sense control signals 54 to cause the electronic display 18 to perform display panel sensing to generate display sense feedback 56. For example, the processor core complex 12 (or a portion thereof, such as image data generation and processing circuitry 50) may determine whether, in frame 92, the current 94 corresponds to a gray level or desired gray level for a pixel 66 above (or at or above) a reference gray level value that corresponds to threshold current value 116. Alternatively, the processor core complex 12 (or a portion thereof, such as image data generation and processing circuitry 50) may determine whether, in frame 92, the gray level or desired gray level for a pixel 66 is above (or at or above) a reference gray level value that corresponds to threshold current value 116. If the current 94 in frame 92 corresponds to a gray level or desired gray level for a pixel 66 above (or at or above) a reference gray level value corresponding to threshold current value 116, or if the gray level or desired gray level for a pixel 66 in frame 92 is above (or at or above) a reference gray level value corresponding to threshold current value 116, the processor core complex 12 (or a portion thereof, such as image data generation and processing circuitry 50) may produce and provide sense control signals 54 (e.g., test data) corresponding to the gray level or desired gray level of the pixel in frame 92 such that the current level to be sensed at time 106 is equivalent to the current level of the TFT driver 82 during frame 92. This allows for a time period 118 (e.g., less than time period 112) that the current 94 of the driver TFT 82 has to settle (e.g., the relaxation time) which represents the time between the start of frame 92 and time 106 corresponding to a sensing of the current (e.g., the driver TFT 82 current). Time period 118 may be, for example, less than approximately 20 ms, 15 ms, 10 ms, 9 ms, 8 ms, 7, ms, 6 ms, 5 ms, or a similar value.

As additionally illustrated in FIG. 11, at time 100 (as the pixel is programed with test data), when the pixel 66 previously had a driver TFT current 98 corresponding to a relatively low gray level, this current 98 swings above the threshold current value 116 corresponding to the test data gray level value. The driver TFT current 94 may continue to move towards a steady state. In some embodiments, the amount of time that the current 98 of the driver TFT has to settle (e.g., the relaxation time) is illustrated as time period 120 (e.g., less than time period 104). At time 108, the pixel 66 may be programmed again with a data value, returning the current 98 to its original level (assuming the data signal has not changed between frame 92 and frame 102). However, as illustrated in FIG. 11 and described above, through dynamic selection of test data sent to the pixel 66 (e.g., selection of a set or dynamic test data value corresponding to a desired gray value that generates threshold reference current 116), the single sided error of FIG. 11 may be reduced in size, thus allowing for more accurate readings (sensed data) to be retrieved as display sense feedback 56, which allows for increased accuracy in the correction values calculated, stored (e.g., in a correction map), and/or applied as compensated image data 52.

Additionally and/or alternatively, sensing errors from hysteresis effects may appear as high frequency artifacts. Accordingly, suppression of a high frequency component of a sensing error may be obtained by having the sensing data run through a low pass filter, which may decrease the amount of visible artifacts. The low pass filter may be a two-dimensional spatial filter, such as a Gaussian filter, a triangle filter, a box filter, or any other two-dimensional spatial filter. The filtered data may then be used by the image data generation and processing circuitry 50 to determine correction factors and/or a correction map. Likewise, by grouping pixels 66 and filtering sensed data of the grouped pixels 66, sensing errors may further be reduced.

Figure 12:
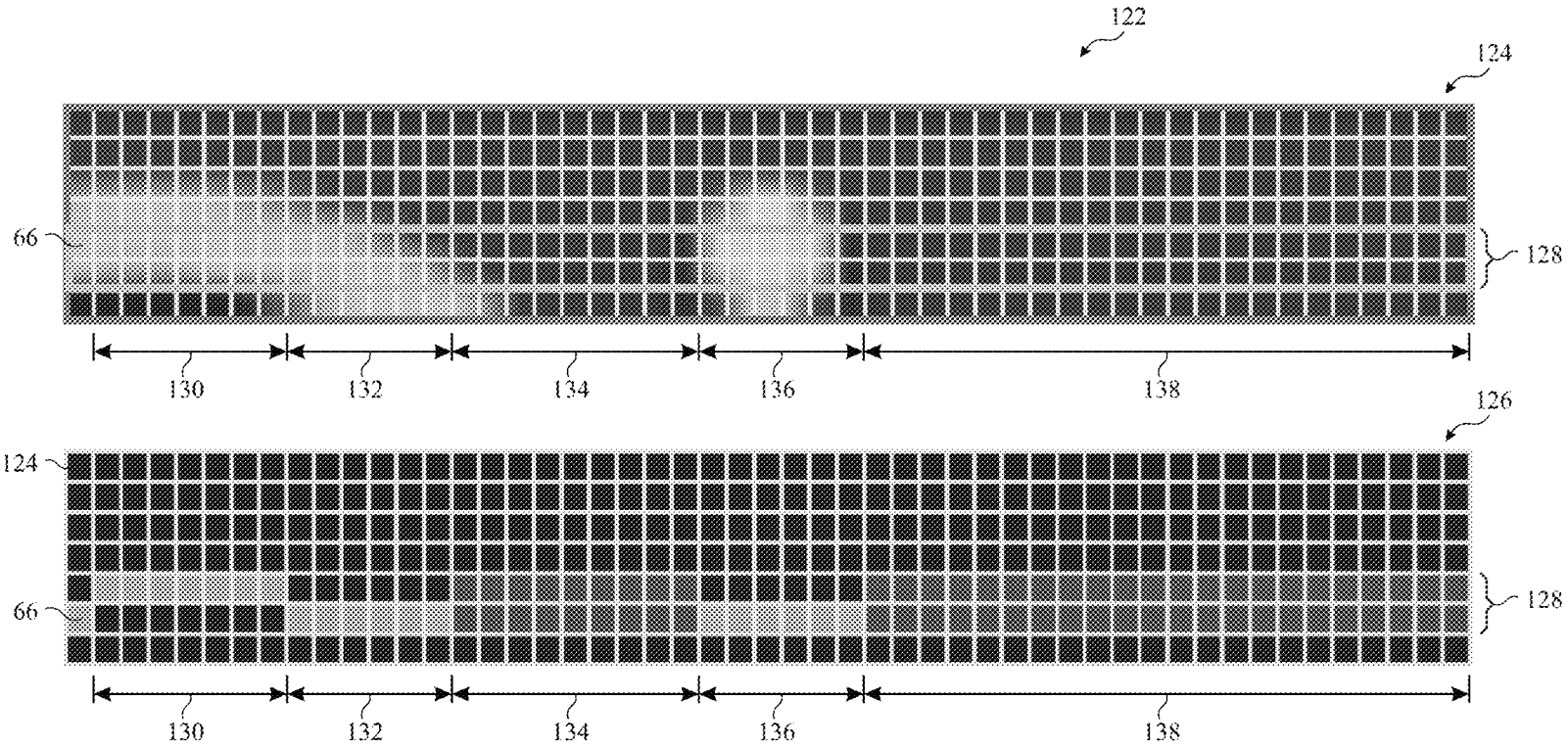
FIG. 12 is a diagram illustrating a portion of the electronic display of FIG. 7, in accordance with an embodiment.

FIG. 12 illustrates another technique for updating of the correction map, for example, using groupings of pixels 66 and utilizing the grouped pixels to make determinations relative to a gray level of test data corresponding to one of either threshold reference current 96 or threshold reference current 116. For example, FIG. 12 illustrates a schematic diagram 122 of a portion 124 of display 18 as well as a representation 126 of test data applied to the portion 112. As illustrated in portion 112, a group 128 of pixels 66 may include two rows of adjacent pixels 66 across all columns of the display 18. Schematic diagram 122 may illustrate an image being displayed at frame 92 having various brightness levels (e.g., gray levels) for each of regions 130, 132, 134, 136, and 138 (collectively regions 130-138).

In some embodiments, instead of performing a display panel sensing operation (e.g., performing display panel sensing) on each pixel 66 of the display 18, the display panel sensing can be performed on subsets of the group 128 of pixels 66 (e.g., a pixel 66 in an upper row and a lower row of a common column of the group 128). It should be noted that each of the group 128 size and/or dimensions and/or the subsets of the group 128 chosen can be dynamically and/or statically selected and the present example is provided for reference and is not intended to be exclusive of other group 128 sizes and/or dimensions and/or alterations to the subsets of the group 128 (e.g., the number of pixels 66 in the subset of the group 128.

In one embodiment, a current passing through the driver TFT 82 of a pixel 66 at location x,y in a given subset of the group 128 of pixels 66 in frame 92 may correspond to a brightness level (e.g., a gray level) represented by Gx,y. Likewise, a current passing through the driver TFT 82 of a pixel 66 at location x,y−1 in the subset of the group 128 of pixels 66 (e.g., a location in the same column but a row below the pixel 66 of the subset of the group 128 corresponding to the brightness level represented by Gx,y) in frame 92 may correspond to a brightness level (e.g., a gray level) represented by Gx,y−1. Instead of the processor core complex 12 (or a portion thereof, such as image data generation and processing circuitry 50) dynamically providing sense control signals 54 to cause the electronic display 18 to perform display panel sensing to generate display sense feedback 56 for each pixel 66 based on a grey level threshold comparison (as detailed above in conjunction with FIGS. 9-11), the processor core complex 12 (or a portion thereof, such as image data generation and processing circuitry 50) may dynamically provide sense control signals 54 (e.g., a single or common test data value) to both pixels 66 of the subsets of the group 128 of pixels 66 based on a subset threshold comparison.

An embodiment of a threshold comparison is described below. If the processor core complex 12 (or a portion thereof, such as image data generation and processing circuitry 50) determines that Gx,y<Gthreshold and Gx,y−1<Gthreshold, whereby Gthreshold is equal to a reference gray level value that corresponds to threshold current value 116 (or the threshold current value 96), then Gtest(x,y) =Gthreshold and Gtest(x,y−1)=Gthreshold, whereby Gtest (x,y) is the test data gray level value (e.g., a reference gray level value that corresponds to threshold current value 116 or the threshold current value 96, depending on the operation of the processor core complex 12 or a portion thereof, such as image data generation and processing circuitry 50) at time 100. Thus, if each of the gray levels of the pixels 66 of a subset of the group of pixels 66 corresponds to a current level (e.g., current 98) below the threshold current value (e.g., threshold current value 116 or the threshold current value 96), the test data gray level that corresponds to threshold current value 116 or the threshold current value 96 is used in the sensing operation. These determinations are illustrated, for example, in regions 134 and 138 of FIG. 12.

Likewise, if the processor core complex 12 (or a portion thereof, such as image data generation and processing circuitry 50) determines that either Gx,y≥Gthreshold and/or Gx,y−1≥Gthreshold, then the processor core complex 12 (or a portion thereof, such as image data generation and processing circuitry 50) may choose one of Gx,y or Gx,y−1 to be applied as Gtest(x,y) at time 100, such that Gtest(x,y)=Gx,y and Gtest(x,y−1)=Gx,y or Gtest(x,y)=Gx,y−1 and Gtest(x,y−1)=Gx,y−1. Alternatively, if the processor core complex 12 (or a portion thereof, such as image data generation and processing circuitry 50) determines that either Gx,y>Gthreshold and/or Gx,y−1≥Gthreshold, then the processor core complex 12 (or a portion thereof, such as image data generation and processing circuitry 50) may choose one of Gx,y or Gx,y−1 to be applied at time 100 to one of the pixels 66 of the subset of the group 128 of pixels 66 and choose a lowest gray level value G0 to be applied to the other one of the pixels 66 of the subset of the group 128 of pixels 66, such that Gtest(x,y)=Gx,y and Gtest(x,y−1)=G0 or Gtest(x,y)=G0 and Gtest(x,y−1)=G0. For example, it may be advantageous to apply separate test data values (one of which is the lowest available gray level or another gray level below Gthreshold) so that when the sensed values of the subset of the group 128 of pixels 66 are taken together and applied as correction values, the correction values can be averaged to a desired correction level when taken across the subset of the group 128 of pixels 66 (e.g., to generate a correction map average for the subset of the group 128 of pixels 66) to be applied as corrected feedback 56, which allows for increased accuracy in the correction values calculated, stored (e.g., in a correction map), and/or applied as compensated image data 52.

In some embodiments, a weighting operation may be performed and applied by the processor core complex 12 or a portion thereof, such as image data generation and processing circuitry 50, to select which of Gx,y and Gx,y−1 is supplied with test data G0. For example, test data gray level selection may be based on the weighting of each gray level of the pixels 66 of the subset of the group 128 of pixels 66 in frame 92, by weighting determined based on characteristics of the individual pixels 66 of the subset of the group 128 of pixels 66 (e.g., I-V characteristics, current degradation level of the pixels 66 of the subset, etc.), by weighting determined by the SNR of the respective sensing lines 88, and/or a combination or one or more of these determinations. For example, if the processor core complex 12 or a portion thereof, such as image data generation and processing circuitry 50, determines that, for example, Wx,y≥Wx,y−1, whereby Wx,y is the weight value of the pixel 66 at location x,y and Wx,y−1 is the weight value of the pixel 66 at location x,y−1 (e.g., a weighting factor determined and given to each pixel 66), then Gtest(x,y)=Gx,y and Gtest(x,y−1)=G0. These determinations are illustrated, for example, in regions 132 and 136 of FIG. 12. Likewise, if the processor core complex 12 or a portion thereof, such as image data generation and processing circuitry 50, determines that, for example, Wx,y−1> Wx,y−1, then Gtest(x,y)=G0 and Gtest(x,y−1)=G0. This determinations is illustrated, for example, in regions 130 of FIG. 12.

It may be appreciated that alternate weighing processes or selection of test data processes may additionally and/or alternatively be chosen. Additionally, in at least one embodiment, sensing circuitry (e.g., one or more sensors) may be present in, for example, AFE 84 to perform analog sensing of the response of more than one pixel 66 at a time (e.g., to sense each of the pixels 66 of a subset of the group 128 of pixels 66 in parallel) when, for example, the techniques described above in conjunction with FIG. 12 are performed. Similarly, alteration to the column driver integrated circuit 68A and/or the row driver integrated circuit 68B may be performed (either via hardware or via the sense control signals 54 sent thereto) to allow for the column driver integrated circuit 68A and the row driver integrated circuit 68B to simultaneously drive each of the pixels 66 of a subset of the group 128 of pixels 66 in parallel The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. An electronic device comprising:

an electronic display comprising an active area comprising a pixel; and processing circuitry configured to:

receive image data to send to the pixel;

adjust the image data to generate corrected image data based at least in part on a stored correction value for the pixel;

generate test data to send to the pixel subsequent to sending corrected image data to the pixel, wherein the test data is selected based upon a comparison of a gray level of the corrected image data with a threshold value to account for hysteresis caused by the corrected image data; and update the stored correction value based on a sensed condition affecting the pixel in response to the test data being sent to the pixel.

2. The electronic device of claim 1, wherein the processing circuitry is configured to transmit the corrected image data to the electronic display.

3. The electronic device of claim 2, wherein the electronic display is configured to utilize the corrected image data to drive the pixel.

4. The electronic device of claim 1, wherein the electronic display is configured to sense the condition affecting the pixel in response to the test data being sent to the pixel.

5. The electronic device of claim 1, wherein the processing circuitry is configured to transmit a first value as the test data when the least one aspect of the corrected image data is at or above the threshold value.

6. The electronic device of claim 5, wherein the processing circuitry is configured to transmit a second value as the test data when the least one aspect of the corrected image data is below the threshold value.

7. The electronic device of claim 1, wherein processing circuitry is configured to generate the stored correction value based upon a sensed condition affecting both the pixel and at least one additional pixel adjacent to the pixel.

8. The electronic device of claim 1, wherein the stored correction value is stored in a correction map configured to store multiple stored correction values.

9. The electronic device of claim 8, wherein the processing circuitry is configured to update the correction map.

10. An electronic device comprising:

processing circuitry configured to:

generate test data to send to a pixel of the electronic device, wherein the test data is selected based upon a comparison of a gray level of corrected image data to be transmitted to the pixel with a threshold value to account for hysteresis caused by the corrected image data.

11. The electronic device of claim 10, wherein the processing circuitry is configured to set the threshold value to an initial predetermined value.

12. The electronic device of claim 11, wherein the processing circuitry is configured to receive or generate the initial predetermined value during an initial configuration of the electronic device.

13. The electronic device of claim 11, wherein the processing circuitry is configured to receive or generate the initial predetermined value during a startup of the electronic device.

14. The electronic device of claim 11, wherein the processing circuitry is configured to generate the initial predetermined value to correspond to a lowest gray level or desired gray level available for the pixel that meets or exceeds a sensing reliability level.

15. The electronic device of claim 11, wherein the processing circuitry is configured to generate the initial predetermined value to correspond to value above a lowest gray level or desired gray level available for the pixel that meets or exceeds a sensing reliability level.

16. The electronic device of claim 10, wherein the processing circuitry is configured to transmit a first value as the test data when the gray level of the corrected image data is at or above the threshold value, wherein the processing circuitry is configured to transmit a second value as the test data when the gray level of the corrected image data is below the threshold value.

17. The electronic device of claim 10, wherein the processing circuitry is configured to generate the corrected image data based upon a stored correction value calculated for the pixel.

18. The electronic device of claim 17, wherein the processing circuitry is configured to alter the stored correction value based on a sensed response of the pixel to the test data.

19. An electronic device comprising:

an electronic display comprising an active area comprising a first pixel and a second pixel directly adjacent to the first pixel; and processing circuitry configured to:

receive first image data to send to the first pixel;

receive second image data to send to the second pixel;

adjust the first image data to generate first corrected image data based at least in part on a first stored correction value for the first pixel;

adjust the second image data to generate second corrected image data based at least in part on a second stored correction value for the second pixel;

generate first test data to send to the first pixel subsequent to sending the first corrected image data to the pixel, wherein the first test data is selected based upon a comparison of a gray level of the first corrected image data with a threshold value to account for hysteresis caused by the corrected image data;

generate second test data to send to the second pixel subsequent to sending the second corrected image data to the pixel, wherein the second test data is selected based upon a comparison of the gray level of the second corrected image data with the threshold value;

update the first stored correction value based on a sensed condition affecting the first pixel in response to the test data being sent to the first pixel; and update the second stored correction value based on a sensed condition affecting the second pixel in response to the test data being sent to the second pixel.

20. The electronic device of claim 19, wherein the processing circuitry is configured transmit identical data as the first test data and the second test data when the gray level of the first corrected image data is less than the threshold value and the gray level of the second corrected image data is less than the threshold value, wherein the processing circuitry is configured transmit differing data as the first test data and the second test data when the gray level of the first corrected image data is greater than the threshold value and the gray level of the second corrected image data is greater than the threshold value.

* * * * *